United States Patent [19]

Choudhury et al.

[11] 4,370,992

[45] Feb. 1, 1983

[54] WASHING APPARATUS FOR SMALL PARTS

[75] Inventors: Hrishikesh Choudhury, Gurnee, Ill.; Juergen H. Zaha, Moore, S.C.

[73] Assignee: Abbott Laboratories, North Chicago, Ill.

[21] Appl. No.: 303,697

[22] Filed: Sep. 21, 1981

[51] Int. Cl.[3] ..... B08B 3/02

[52] U.S. Cl. ..... 134/100; 134/134; 134/141; 134/153

[58] Field of Search ..... 134/100, 134, 141, 153

[56] References Cited

U.S. PATENT DOCUMENTS

| | | | |
|---|---|---|---|
| Re. 29,656 | 6/1978 | Chittenden et al. | 128/272.3 |
| 1,191,573 | 7/1916 | Dawson | 134/134 |
| 2,299,965 | 10/1942 | Davis | 134/134 X |
| 2,746,465 | 5/1956 | Farison | 134/100 X |
| 3,216,419 | 11/1965 | Scislowicz | 128/214 C |
| 3,750,685 | 8/1973 | Brenneisen et al. | 134/141 X |
| 3,938,520 | 2/1976 | Scislowicz et al. | 128/272.3 |
| 4,005,710 | 2/1977 | Zeddies et al. | 128/214 R |

*Primary Examiner*—Robert L. Bleutge
*Attorney, Agent, or Firm*—Neil E. Hamilton; Robert L. Niblack

[57] ABSTRACT

A washing apparatus for small parts which will permit the loading of the parts into the apparatus in a fast and efficient manner and at the same time will afford maximum cleaning of the parts. The particular component parts for which the machine is specifically designed are utilized in the fabrication of intravenous solution administration sets. The washing apparatus includes a plurality of basket members which are pivotally carried by a rotatable carrier member. The baskets are pivoted in such a manner in conjunction with the apparatus that they can be extended outwardly for emptying purposes, yet are locked into the carrier so that the parts are retained therein. A spray system is also provided in the washing apparatus so as to afford maximum cleaning of the parts as well as a rinsing of the washing solution with subsequent drying.

12 Claims, 11 Drawing Figures

WASHING APPARATUS FOR SMALL PARTS

BACKGROUND OF THE INVENTION

This invention relates to a washing apparatus for small component parts to be utilized in the fabrication of devices for administering sterile drugs and solutions. More particularly, this invention relates to an apparatus for washing small component parts in a highly efficient manner which is accomplished by means of basket members which are extendable from outside the confines of the machine for loading and unloading purposes. Maximum washing of the component parts is afforded by the basket members which have wall panels composed of heavy screen-like material in combination with a washing action and a rinse spraying system which affords maximum washing and rinsing of the parts. A drying system is also provided in the washing unit and the unit is susceptible to various forms of electronic programming.

The components of the type for which the apparatus of this invention is especially utilized are disclosed in U.S. Pat. Nos. 3,216,419; 3,938,520; 4,005,710; and Reissue No. Re-29,656. It will be appreciated that the component parts such as the float valves, backcheck valves, drip chambers and piercing units described in these patents will be individual components prior to their being fabricated into an I.V. administration set or assembled into operable devices. In order to assure that the parts are clean in the sense that they contain no oils or particulate matter, they must be washed thoroughly. In the past, this was accomplished by tumble washing in distilled water or employing ultrasonic washing in organic solvents. In order to make the cleaning process feasible for a large number of parts, it is necessary that an apparatus be utilized which can accept a large number of component parts and wash them in a manner which will assure that they are completely cleansed.

It is an advantage of the present invention to provide a novel apparatus for washing small component parts in a fast and efficient manner. It is another advantage of this invention to provide an apparatus for washing components to be utilized in the administration of drugs or I.V. solutions wherein each part is thoroughly contacted with filtered washing solution, filtered sterile rinse water and then completely dried. It is still another advantage of this invention to provide a washing apparatus which is adapted to being easily loaded, automatically operated and conveniently emptied. It is yet another advantage of this invention to provide an apparatus for washing small component parts wherein maximum efficiency can be made of the wash and rinse water, such as reusing the filtered rinse water, yet will afford maximum rinsing of each component part. It is another advantage to wash and clean different commodities at the same time, due to multiple basket loading and without cross-contamination between the basket members.

SUMMARY OF THE INVENTION

The foregoing objects are accomplished and the shortcomings of the prior art are overcome by the present apparatus wherein a carrier member is enclosed and supported by a frame and housing. The carrier member is rotably mounted on the frame and on a horizontal axis. A plurality of basket members are supported by the carrier member. The basket members have sections formed of a porous material which will retain the parts therein but will allow washing fluid to enter and exit. The basket members also have doors for loading and unloading the component parts in the baskets. Nozzles are disposed inside the housing of the washer unit and arranged to direct the washing and rinsing fluid into the basket members at predetermined positions. Drainage means are provided to drain the washing and rinsing fluid from the housing at positions below the nozzles and below the lowest portion of the basket members only. The basket members are positioned on the carrier member so that in one position the basket member is carried within the confines of the carrier, yet in another position, the basket members can be positioned through an opening in the housing and extend outside the confines thereof. A locking mechanism is utilized in conjunction with the basket members so that they will be secured in the carrier member. The basket members are so pivoted with respect to the carrier member that they can be moved automatically to a position below a horizontal plane for ease in emptying the component parts only with the use of basket locking key. In order to afford maximum flow of washing fluid through the baskets, the basket members are composed of side, top, bottom and front wall members, all composed of heavy perforated sheet material. In order to afford maximum washing of the parts, nozzle means are disposed above the baskets as well as at the sides and central area of the carrier. Drying of the parts is assured by means to introduce hot air into the center of the housing and adjacent the center of the carrier member.

BRIEF DESCRIPTION OF DRAWINGS

A better understanding of the washing apparatus will be afforded by reference to the drawings wherein.

DESCRIPTION OF THE PREFERRED EMBODIMENT

Figure 1:
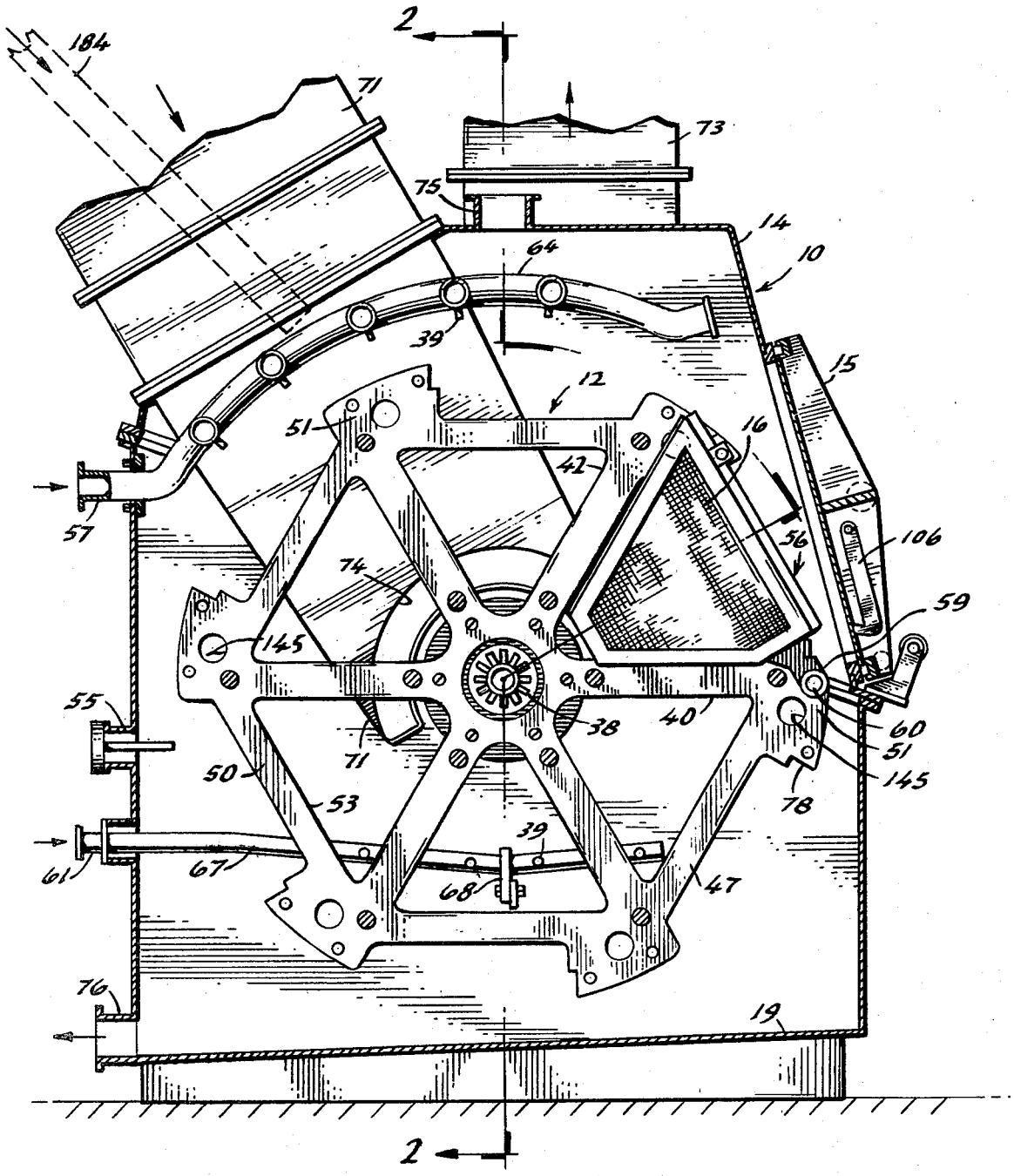
FIG. 1 is a side view in vertical section illustrating the washing apparatus of this invention.

The washing apparatus 10 is shown in FIGS. 1-6 and 11. It includes a carrier member 12 rotatably supported in a frame and housing 14, the interior to which is made accessible by means of a door 15. Basket members such as 16 will be pivotally and rotatably supported on carrier member 12 which in effect is in the form of a spider wheel 50 formed from opposing end frame portions 52 and 53. Wheel 50 includes radiating arms 40 and 42 which are interconnected across their ends such as by means of circumferential bars 47. As best seen in FIG. 1, the basket members will be carried inside each of these triangular portions formed by radiating bars 40 and 42 and cross bars 47 so that in effect, six such basket members will be carried between end frames 52 and 53 with the basket assembly having a configuration being generally trapezoidal so as to fit within the area defined by the radiating arms 40 and 42, as well as bar 47. Bearing flanges 51 are disposed in carrier flanges 78 to accommodate basket members 16.

Figure 2:
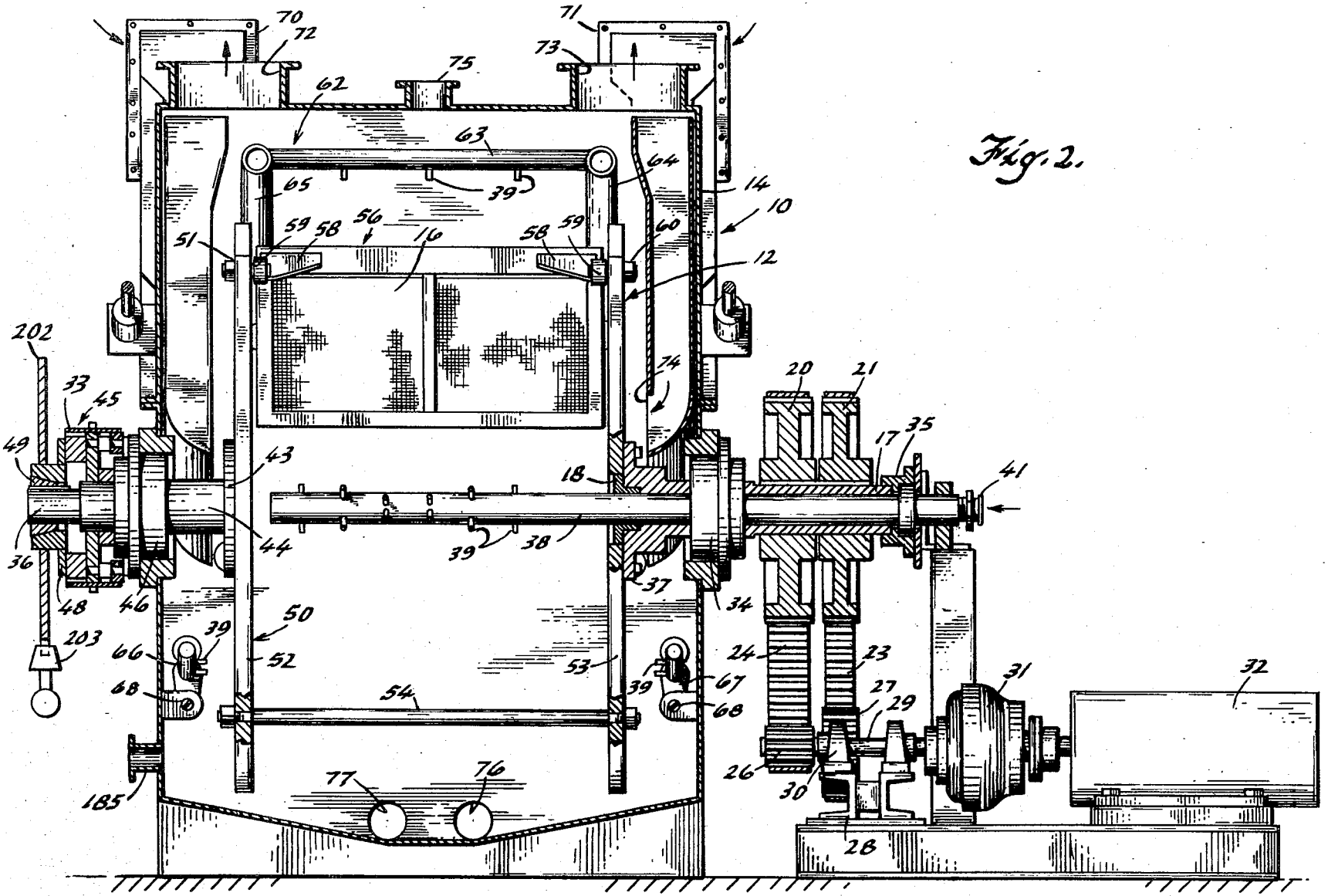
FIG. 2 is a view in vertical section taken along line 2—2 of FIG. 1.
Figure 11:
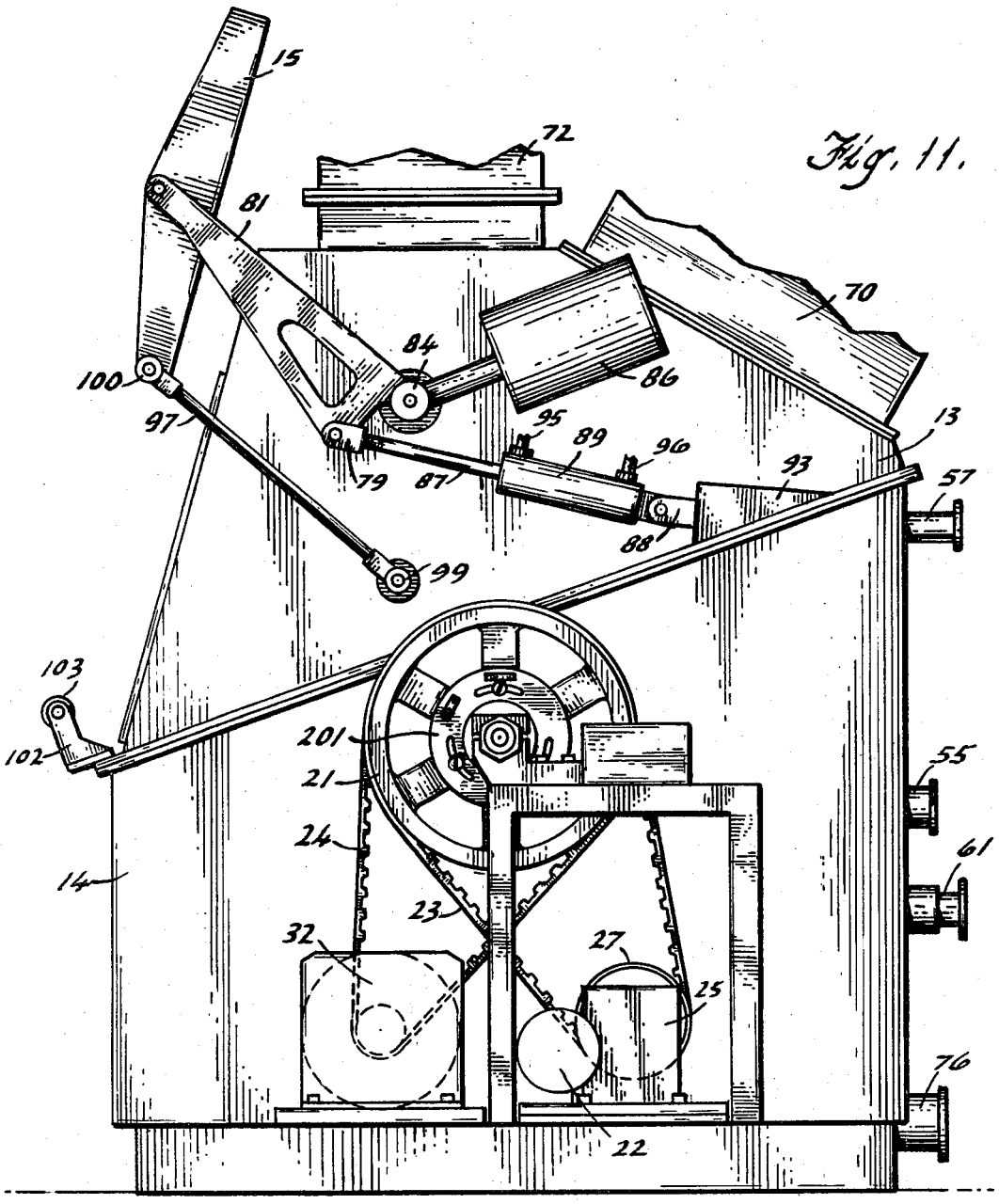
FIG. 11 is an end view in elevation showing the drive mechanism for the present apparatus.

Referring specifically to FIGS. 1 and 2, it will be noted that washing apparatus 10 has several nozzle members positioned at various places within housing and frame 14. For example, two upper and arcuately extending spray arms 64 and 65 are provided as well as an interconnecting spray arm 63. Disposed laterally and downwardly in housing 14 are spray manifolds 66 and 67. Centrally positioned inside carrier 12 is spray manifold 38. Efficient drainage of the washing and rinse solutions is provided from washing apparatus 10 through pitched floor 19 extending downwardly toward two drainage conduits 76 and 77. Warm air is delivered inside housing 14 by two air ducts 70 and 71 and exits from the machine through exit air ducts 72 and 73. A duct 75 is provided for the purpose of providing an emergency stop mechanism, if desired. The drive mechanism for rotating carrier emergency member 12 and the baskets 16 is best illustrated in FIGS. 2 and 11. A drive shaft 17 has secured thereto drive wheels 20 and 21 with drive belt 24 engaging drive wheel 20 and being driven by drive wheel 26 mounted on drive shaft 29 for a high speed operation. Drive shaft 29 will be journaled in bearing housing such as 30 and will be driven by means of high speed drive motor 32 through gear coupling 31. Suitable support such as 28 is provided for the bearing housings 30. A belt 23 will engage drive wheel 21 and will, in turn, be driven by drive wheel 27 of low speed drive index 25 which in turn is actuated by low speed motor 22.

As will be seen in FIG. 2, basket assembly 56 includes basket member 16 which is pivotally attached to carrier 12 through a pair of basket mounting flanges 58 from which extend flange bushings 59. The pivotal connection is made by the usual nut and stud 60 which will be fixed in apertured flanges 51 (see FIG. 1). Opposite the drive shaft 17 is a brake and adapter assembly generally 45 which includes a bearing housing 46 for shaft 44 connected to the carrier 12 through connecting flange 43. An indexing wheel 202 is also mounted on shaft 36 to be engaged by stop member 203. In a similar manner, drive shaft 17 is connected to carrier 12 at the opposite side through connecting flange 37 with bearing cartridge 34 surrounding shaft 17. Included with brake and adapter assembly 45 is a centering ring 49 as well as bushing 48. It will be noted that a stub shaft 36 is formed as a part of shaft 44 and is centered by means of centering ring 49. The usual guard housing 33 is disposed around the brake and adapter assembly.

Figures 3, 4:
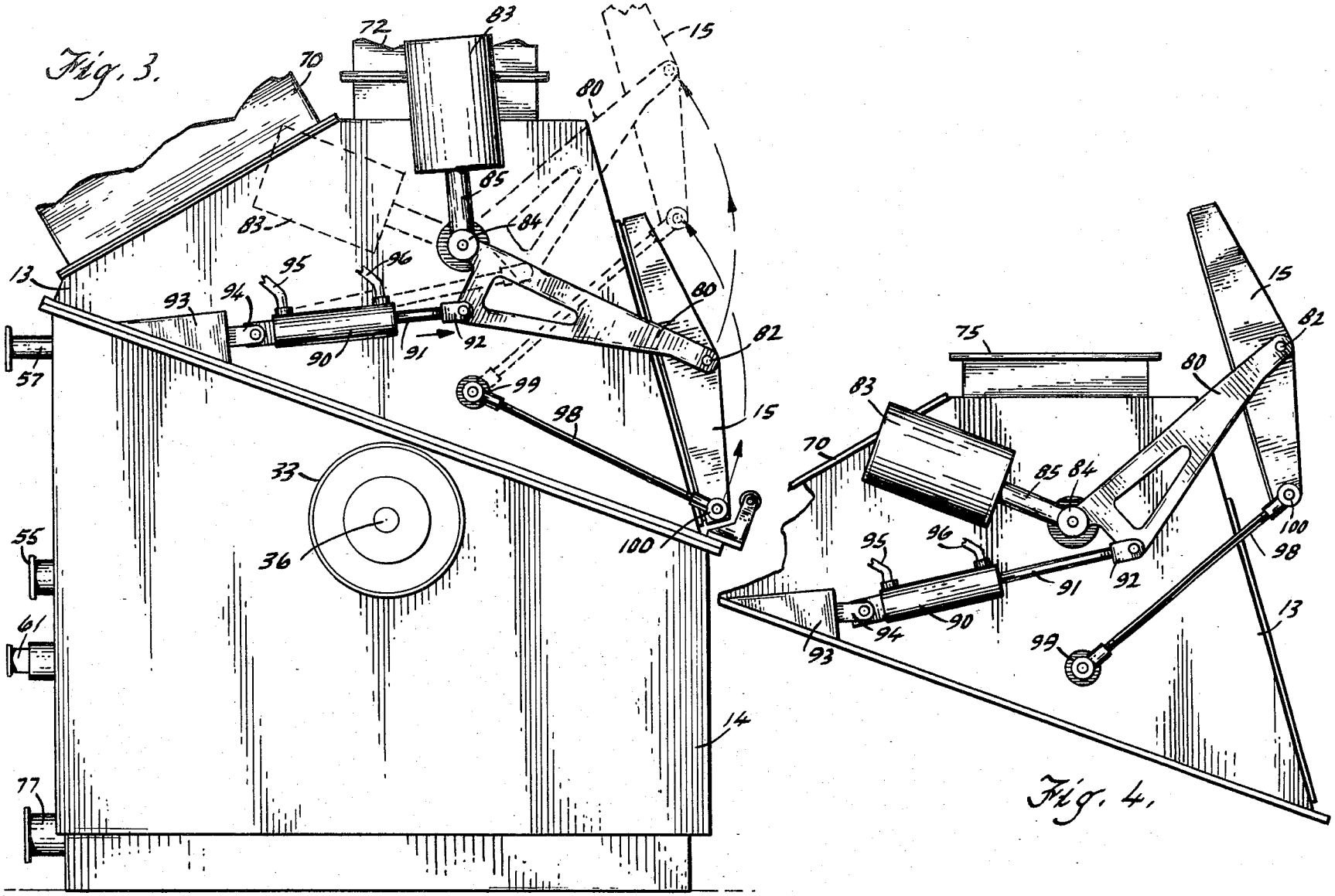
FIG. 3 is a view in side elevation illustrating the door mechanism for the apparatus of this invention.
FIG. 4 is a detailed view of the door mechanism illustrated in FIG. 3 in the open position.

Referring to FIGS. 3 and 11, it will be seen that the door member 15 is hingedly attached to the upper housing 13 of frame and housing member 14. The hinged attachment is afforded through arms 80, 81 and pivotal connections such as 82 at one end with arms 80, 81 secured to pivot pin arms 84 at the opposite end and consequently to housing 13. The weight of the door is counterbalanced through counterbalancing weights 83 and 86, also secured to pivot pin arms 84. The door is actuated through air cylinders 89 and 90 which has the usual air cylinder arms 91 and 87 as well as air lines 95 and 96. Cleavis 88 and 94 pivotally attaches the air cylinders to housing 13 at one end through support blocks 93 with cleavis 79 and 92 attached to arms 87 and 91 pivotally securing the cylinder to door arms 80 and 81. Guide rods 97 and 98 are also pivotally attached to door 15 through pivot connections 100 and to housing 14 through pivot pin arms 99. The movement of door 15 from the closed to the open position is illustrated in FIG. 3 with the dotted line version of door 15 showing it in the open position.

Figure 5:
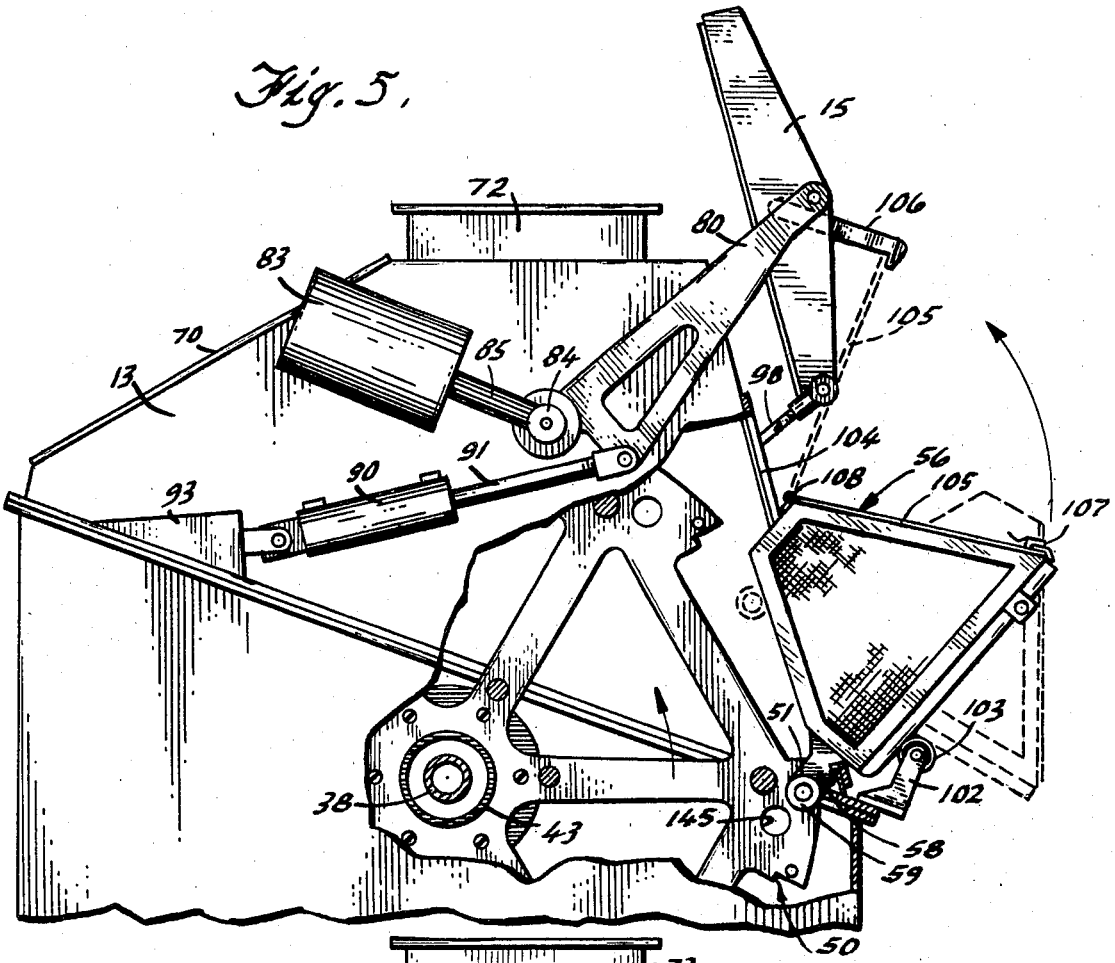
FIG. 5 is a partial view of the apparatus in side elevation with portions broken away showing the basket member extending from the apparatus and in a position to be loaded with parts.
Figure 6:
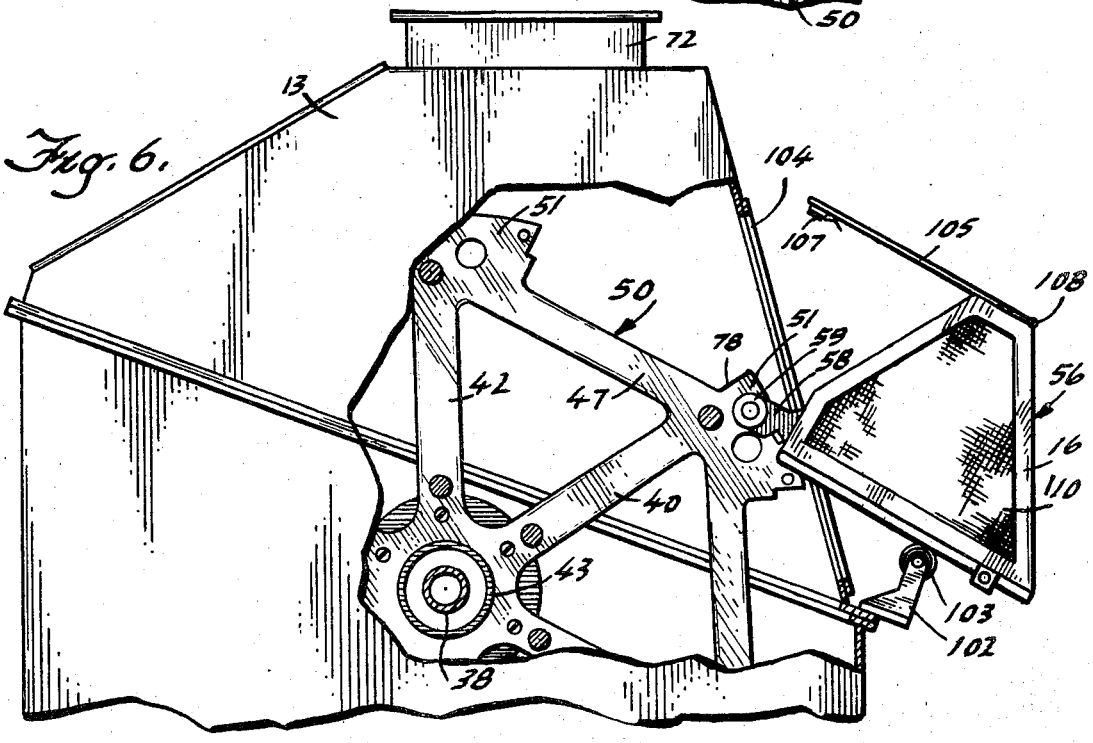
FIG. 6 is a view similar to FIG. 5 except showing the basket member in a position for emptying the parts therefrom.

FIGS. 5 and 6 illustrate the extension of the basket assembly 56 extending through the open doorway 104 of upper housing 13. This extension is afforded through basket mounting flanges 58 and flange bushings 59 pivotally secured to spider wheel 50. As specifically shown in FIG. 5, basket assembly 56 is shown in the loading position as it is hinged away from the spider wheel and supported to the outside of housing 14 by basket holding support 102 which has a roller 103 rotatably mounted thereon. Basket lid 105 which is attached to the basket through a hinge 108 can be supported in an upward position such as by means of basket hook 106 suitably mounted on door 15. As specifically shown in FIG. 6, when the spider wheel 50 is rotated in a counterclockwise movement so that the basket mounting flange 58 mounting the basket is moved in a midway position in doorway 104, basket assembly 56 will be tilted to a position such that the bottom thereof is automatically pivoted below a horizontal level plane for ease of emptying. In this declined position it will be noted that basket assembly 56 is also supported on roller 103 and lid 105 will be opened in an over-center position.

Figure 7:
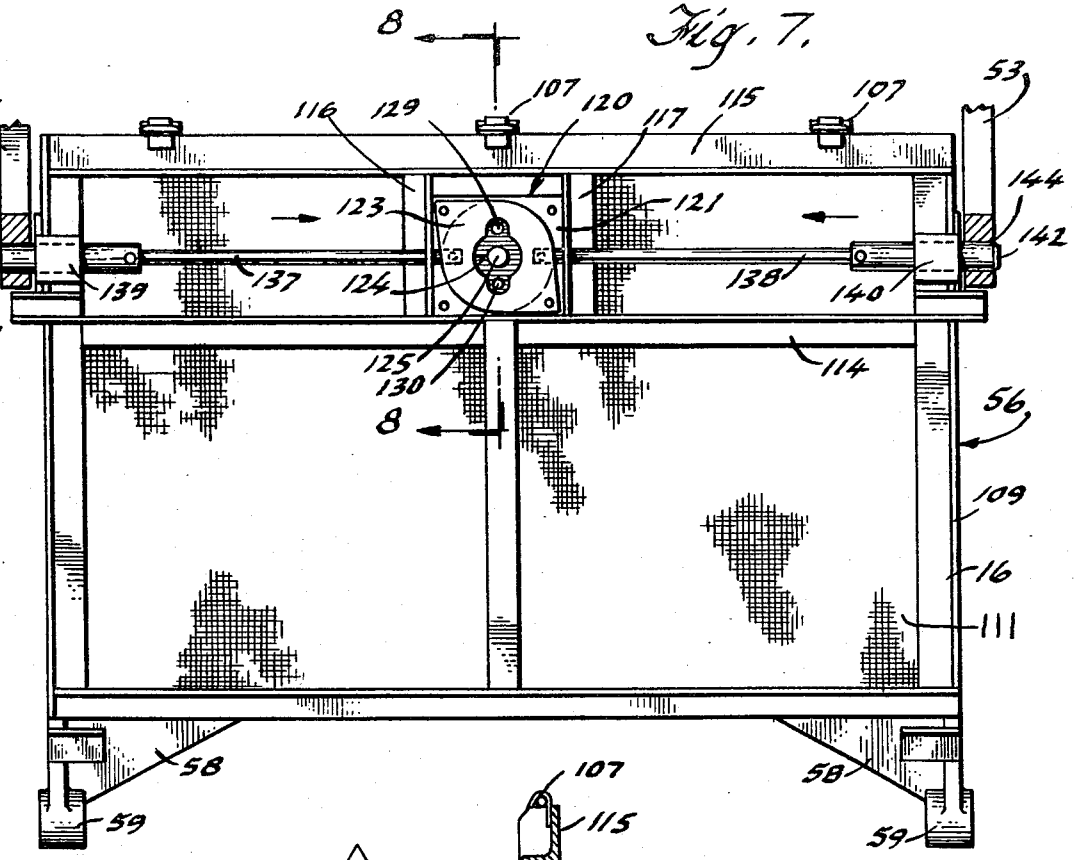
FIG. 7 is a detailed view illustrating the basket member with a view from the front thereof.
Figure 8:
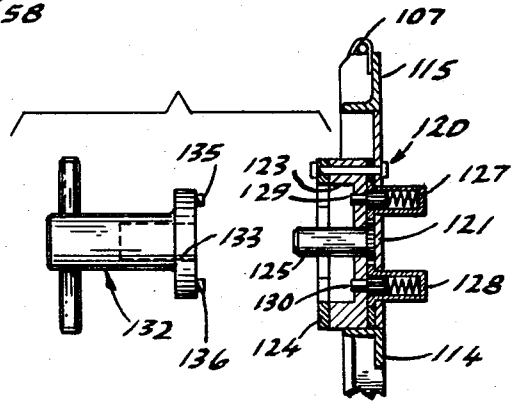
FIG. 8 is a view in vertical section taken through line 8—8 of FIG. 7.
Figure 9:
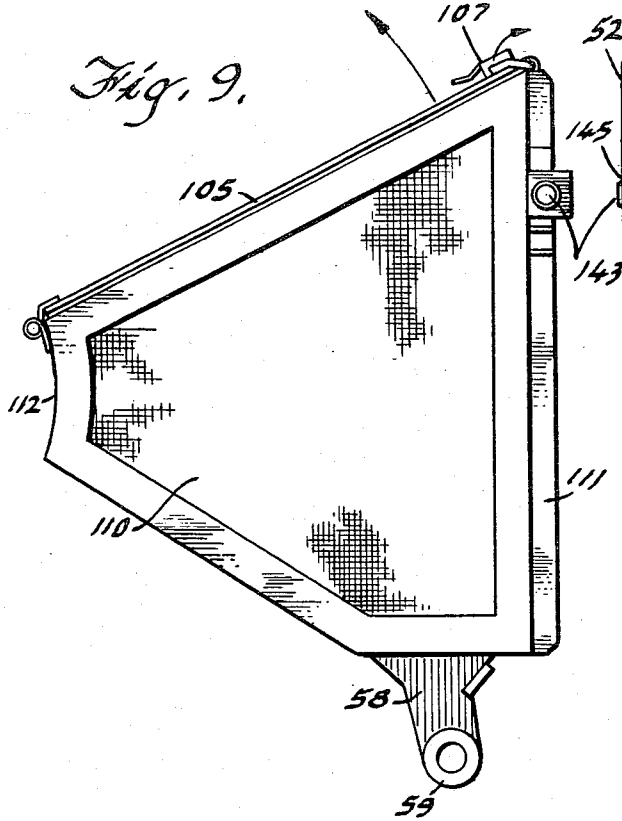
FIG. 9 is a side view of the basket member shown in FIG. 7.

The details of the basket assembly 56 which includes basket member 16 is best shown in FIGS. 7, 8 and 9. The basket assembly is formed from a frame 109 which is generally trapezoidal in shape defining a six-sided member including side walls 110, front wall 111, a curved back wall 112 and lid 105, all formed from a heavy perforated sheet or mesh material supported by frame 109. The lid 105 is attached to frame 109 through latches 107. Also carried by frame 109 are support bars 114, 115, 116 and 117 which position key assembly 120 on basket 16. Key assembly 120 includes a support plate 121 in which is rotatably mounted a rotatable disk 123 having a keyway 124. Extending from rotatable disk 123 are oppositely positioned rod members 137 and 138 which are journaled through bushings 139 and 140 and having slide bars 142 and 143 extending therefrom and accommodated in openings 144 and 145, of end frames 53 and 52 respectively, of the spider wheel. This is for the purpose of locking the basket assembly 56 therein.

As best seen in FIG. 8, rotatable disk 123 is rotated through a key 132 having a central compartment 133 for accommodating central post 125 for guidance thereon. Spring loaded detents 127 and 128 include the usual posts 129 and 130 for contact and displacement by projections 135 and 136 so that key 132 will turn rotatable disk 123 in the usual manner.

Figure 10:
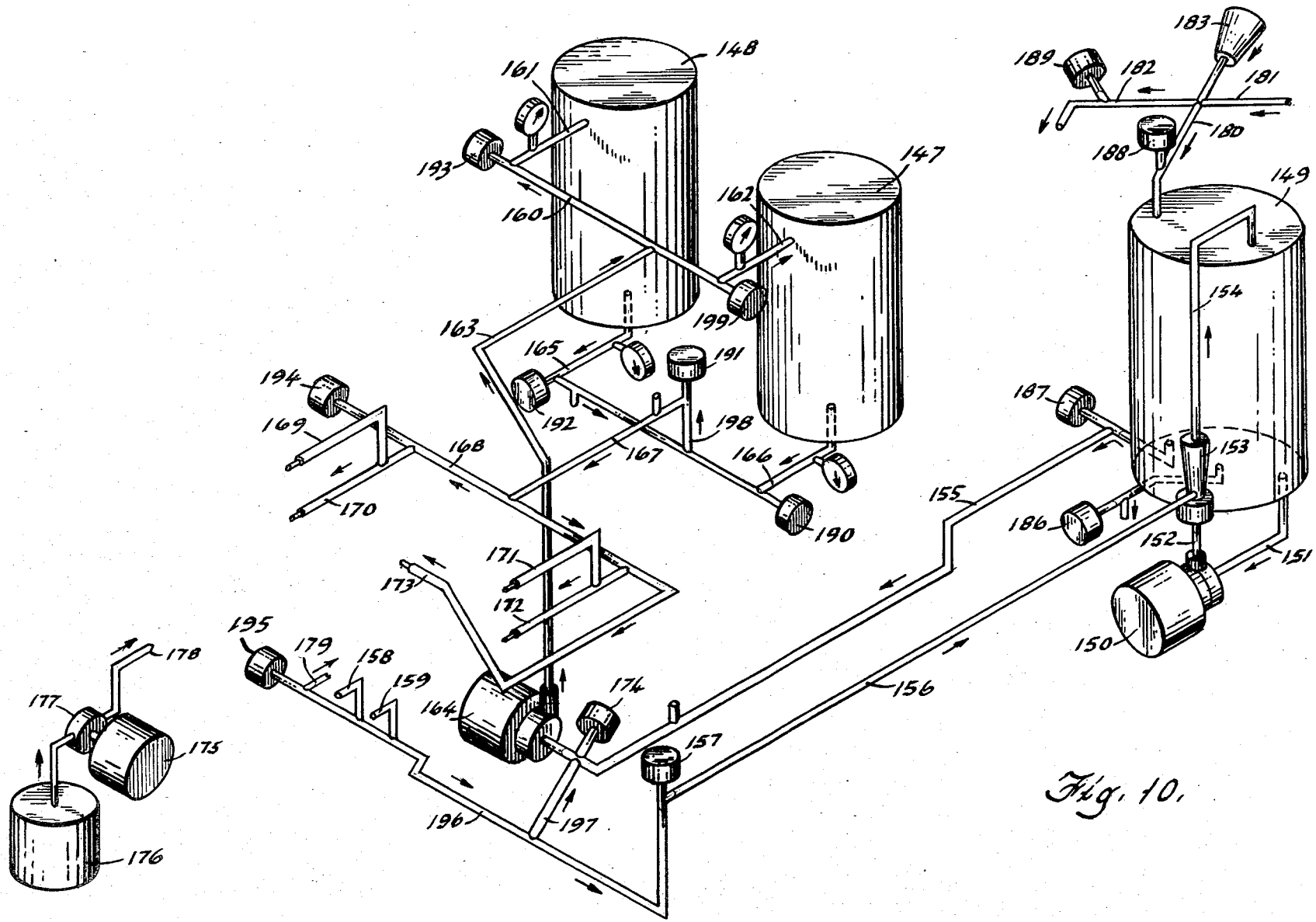
FIG. 10 is a plan view illustrating the piping and supply system for the washing and rinsing fluids to be used in connection with the apparatus of this invention.

Referring to FIG. 10 of the drawings, the washing fluid supply and rinsing system is described. It includes a water storage tank 149 which is interconnected to washing apparatus 10 through pipelines 155 and 156. Line 156 will serve to convey water from washing apparatus 10 by its interconnections of lines 158 and 159 to outlet pipes 76 and 77 of washing device 10. Line 155 will serve to return water from tank 149 to washing apparatus 10 by means of pump 164. It will be noted that pump 164 is interconnected with line 163 which in turn interconnects with filter tanks 148 and 147. This is accomplished by branch lines 160, 161 and 162. Return lines 165, 166 and 167 interconnect with line 168 and ultimately connecting lines 169, 170, 171, 172 and 173. Line 170 would for example, interconnect with spray manifold 66, line 169 with spray arm 65, connecting line 172 with spray manifold 67, connecting line 171 with spray arm 64 and connecting line 173 with central spray nozzle manifold 38. Suitable valves such as 157, 174, 186–190 are provided to direct the wash water and rinse water through the various pumps and pipe lines in a manner to be further described in the operation. It will be noted that a pump 175 is provided to draw detergent from tank 176 through pipe line 177 and connecting line 178 into washing device 10 through detergent inlet 55.

As best seen in FIG. 11, a low speed drive source is represented by drive motor 22, drive index 25 and drive wheel 27. A high speed drive source is provided by drive motor 32. These drive sources are synchronized for proper orientation of the basket members 16 with respect to doorway 104 by means of indexing wheel 202 with stop member 203. Suitable controls will be provided between indexing wheel and brake assembly 45 to effect acuation of stop member 203 at the appropriate position. Photocell device 201 is provided for the purpose of exactly locating basket member 16 in doorway 104 during loading and unloading.

Operation

A better understanding of the advantages of the washing apparatus 10 will be had by a description of its operation.

Air cylinders 90 will have been activated so that arms 91 are extended to position door member 15 upwardly as shown in FIG. 5. In order to load component parts into the baskets, such as 16, key 132 will be inserted into key assembly 120 in such a manner that projections 135 and 136 will engage in the apertures presently occupied by posts 129 and 130. A turning of the key will then move slide bars 142 and 143 out from the openings 144 and 145 of end frames 52 and 53. It will be appreciated that carrier member 12 will be positioned by indexing means including indexing wheel 202, brake 203 and photocell device 201, to a position such as indicated in FIG. 5 so that the basket mounting flange 58 will be positioned adjacent the bottom portion of doorway 104. Basket lid 105 will be in an upward position and retained by basket hook 106. In this position, parts, such as stoppers, sight chambers, and valve units, will then be loaded into the basket member to a desired level after which the basket lid will be pivoted back to close the basket member by means of latches 107. The basket member 25 is then moved inwardly into carrier member 12 to a position as shown in FIG. 1 with the top and bottom of the basket member resting between radiating arms 40 and 42. Key 132 will again be inserted into key assembly 120 and rotated so that slide bars 142 and 143 will again engage openings 144 and 145 in spider wheel 50. This procedure will be followed with the additional five basket members which will also be carried in a similar manner in the carrier member. When all of the baskets are filled and in place, air cylinders 90 will again be activated so that arm 91 is retracted to close the door member 15 over the doorway 104.

The next procedure is to place washing water in the washing apparatus 10 which will be referred to as the wash cycle. Water which is preferably softened will enter under pressure through lines 181 and 182 when valve 189 is in an open position. Although not shown, a valve and a flow meter will be used in conjunction with line 182 and and after a predetermined amount of water has entered the machine, will close the valve 189, as well as another valve on line 181 (not shown). After a sufficient quantity of water is placed in machine 10 so that it reaches a predetermined level, pump 175 will be activated to draw a liquid detergent from tank 176, through line 178 and connection 55 into washing apparatus 10. It will be noted that when the washer is filled, the water enters in through line 184 (see FIG. 1) from line 182 so as to have the incoming, filling water wash over the basket members 16 in carrier 12. In order to effect efficient detergent action, air will next be introduced in through line 185 from a suitable pressurized air source in order to cause an effective mixing of the detergent in the water and also cavitate the water for scrubbing action. Low speed drive motor 22 and drive index 25 will then be energized and will effect a slow rotation of carrier 12 by means of drive wheel 27 and drive belt 23. Valve 189 will now be closed and pump 164 actuated in order to recirculate the water with the detergent through filter tank 148. This will be effected by water being drawn from the washer through connecting pipes 158 and 159 through lines 196, 197, 163, 160 and 161 to filter 148, which will be effected by opening valves 193 and 174. Detergent water will return from filter tank 148 through lines 165, 198, 167 and 168 by opening valve 192, 191 and detergent water will flow into spray manifolds 63, 64, 65, 66 and 67 by means of connecting lines 169, 170, 171 and 172. Central spray nozzle manifold 38 will also have the detergent wash water supplied by means of connecting pipe 173. This cycle of recirculation and filtering through the eight mycron filter banks in filter tank 148 will be effected for a period of one to fifteen minutes. After the wash cycle is completed, pump 164 will be stopped and valve 195 actuated to drain the water from the washing machine by means of pipe 179 interconnected with connecting pipes 158 and 159. While the drain valve is open the inner carrier member will rotate at approximately 2 to 5 revolutions per minute for draining purposes.

The next phase in the washing cycle is the soft water rinse cycle which is accomplished by opening valve 188 to fill storage tank 149. Pump 150 will be actuated for a closed loop venturi effect on pipe line 156 with valve 157 being opened. Soft water will enter through lines 181 and 182 with valve 189 being open and valve 188 being closed. Valve 187 will also be opened and pump 164 actuated. This will cause water to flow through line 163, to filter tank 148 and through the nozzles into the washing machine. The siphon system will evacuate used rinse water from washer 10 through valve 157 to the motive tank. The water will be recirculated through filter 148 to washer 10 and returned to motive tank 149. It will be drained from the washer 10 and the motive tank 149 by opening valves 195 and 186 respectively.

The next phase in operating the washing device is the distilled water rinse. Distilled water will enter by a suitable supply line through air gap funnel 183 and will be circulated into the washing device and drained therefrom in the same manner as in the soft water rinse. The only difference being that in this instance, filter tank 147 will be utilized which will means that valves 199, 191 and 190 will be opened while valves 193 and 192 are closed.

The last phase is the drying cycle which will follow the distilled water rinse. This is more particularly described later in the paragraph describing certain operating conditions.

As an alternative procedure to the foregoing operation the following wash and rinse cycles could be employed. The load and unload procedures will be the same as previously described. The wash cycle will begin with valves 189 and 194 being opened and allowing a predetermined amount of water to fill the washer 10. Pump 175 will inject detergent water inside the washer and slow speed motor 22 will rotate carrier member 12 and members 16 containing washing commodities. Oil free compressed air will be introduced through pipe line 185 to effect agitation of the water (scrubbing action). At the end of the wash cycle, drain valve 195 will open. At the same time, slow speed drive 25, 23 and 21 will be disconnected and the high speed drive, 32, 24 and 20 will spin the basket members 16 to remove detergent water and particulates from the commodities. The high speed drive will be disconnected and drain valve 195 will stay open to drain all detergent water from the washer.

The first rinse cycle will then be initiated and valve 189 will close and 188 will open to allow a predetermined amount of water to fill the motive tank 149. Valves 187, 193, 192, 191 and 157 will open. Slow speed motor 22 will drive the basket members 16. Spray pump 164 will pump water from the motive tank through filter 148 and spray to the basket member to rinse the commodities, and drain valve 195 will stay open in order to drain all the rinsing water from the washer.

The second rinse cycle will then follow with valves 189 and 188 being opened to allow a predetermined amount of water to fill the motive tank 149. Valves 157, 189, 191, 190 and 191 will open and valve 195 will close. Siphon pump 150 will start pumping water across the motive tank 149. The siphon system will evacuate water from the washer 10 through valve 157 to the motive tank. Spray pump 164 will next pump water from the motive tank 149 through filter 147 and spray water to the basket assembly to rinse the commodities. This causes water to re-circulate due to the siphon system and motive tank 149. Drain valves 195 and 186 will subsequently open. Slow speed drive 25, 23 and 21 will be disconnected and high speed drive 32, 24 and 20 will spin the baskets 12 to extract water from the commodities. The extract cycle will repeat two times or more, as required to extract maximum water. Hot air from ducts 70 and 71 will be circulated inside the washer during the extract cycle. Hot air will continue to circulate and drive will be changed from the high speed to the low speed. The drying cycle will continue until the commodities are completely dry and the operating sequence completed.

Certain operating conditions are preferred in utilizing the previously described washing device during its operation. For example, it has been found that clean, oil-free air filtered to 5 micron should be utilized when being introduced through inlet pipe 185. The preferred pressure for the air should be 75–100 psi for purposes of cavitation and scrubbing action. The pressure for the rinse water during the rinse cycles should be at a pressure of 30 to 50 psi and a flow rate of 190 to 210 gallons per minute.

As indicated earlier, the basket members 16 will be rotated to 2 to 5 revolutions per minute during the wash cycle. During the rinsing cycles, the preferred rotation is at 2 to 5 rpm with the preferred wash and rinse cycles being 1–4 minutes. During the drying cycle, filtered, heated and deionized air will be introduced near the center of the baskets, such as by arcuate orifices 74 of ducts 70 and 71, and simultaneously the carrier will be rotated smoothly in an accelerated manner to 300 to 350 rpm to generate 75 to 100 g. for the purpose of spinning off residual water and particulate matter. Air will be introduced at approximately 3,000 cubic feet per minute which in effect means that 1,500 cubic feet per minute will be introduced at each side of the carrier. The temperature of the air will be 120° F. to 140° F.

At the conclusion of the drying cycle, carrier 12 will be stopped so as to position a pivoting and retaining bracket 51 approximately near the bottom of doorway 104. A loaded basket will be moved outwardly from carrier 12 in the manner previously described when placing parts therein. A basket will assume a position shown in FIG. 6. In this mode, parts will fall freely therefrom and outside the confines of the washing device.

It will be appreciated that in some instances water may be retained between door member 15 and the surrounding surface area of housing 14. If desired, additional air conduits can be connected to air ducts 70 and 71 to direct warm air to the area inside the door to evaporate the water.

Certain features of the washing apparatus are important and accomplished in washing components which are to be utilized in the manufacture of equipment for administering I.V. solutions. One of these features is the aspect that during the rinse cycle no water is allowed to accumulate at the bottoms of the washing baskets so that the parts are not recontaminated. Instead, the rinse water is immediately evacuated from the washing apparatus and filtered before it is returned for subsequent rinsing. Another feature is in utilization of washing baskets with walls which are perforated to permit the water to readily enter therein, yet at the same time are continuously rotated to promote a tumbling action of the parts therein to afford maximum contact of the parts with the washing and the rinsing solutions. This unique washing action is effected by the movement of the baskets as they rotate from the 9 o'clock to the 12 o'clock position in conjunction with the angular dispostion of spray nozzles 39. Cross contamination between the basket members is substantially eliminated due to central spray manifold 38 providing high pressure washing and rinsing liquids through nozzles 39 which will force all liquids upwardly and outwardly. Still another important feature is the drying of the parts wherein the warm air is introduced at the center of the carrier member while the carrier member is being rotated. This in effect effects a three-fold function in that the centrifugal force of the parts will create a negative pressure near the center of the carrier, thus permitting the warm air to rinse through the parts and be carried through the baskets outwardly in the washing apparatus before being evacuated. At the same time, the parts are being constantly tumbled as they were in the washing and rinsing cycles, contributing a highly efficient method of drying. The use of a plurality of basket members also offers the following advantages: they reduce the abrasive effect between the small parts and the basket walls during tumbling; and they allow the washing of more than one type of part during a wash cycle.

It will be apparent that the washing apparatus is susceptible to being highly automated when suitable controls such as a Texas Instrument's computer programmer and inner phase with a manual override, such as a Model 5TI is utilized in conjunction with the washing device. This provides the options of varying the process to a very high degree in the novel functions of the machine in the wash and rinse cycles. The washing apparatus can also be integrated with an automatic loading and unloading mechanism in that the basket members 16 can be positioned outside the machine. This offers still another advantage in that parts will not fall into the machine.

While the present washing apparatus has been described as basically a washer and dryer for small component parts, it could be utilized also as an autoclave by converting the frame and housing 14 to a pressure vessel. Further, an ultrasonic transducer could be placed in the bottom of the housing and used as a water-ultrasonic cleaner, washer, dryer and autoclave combination. If desired, solvent proof seals could be employed and a solvent degreaser employed along with ultrasonic cleaning, washing and drying with solvent recovery during the drying cycle as well as an air purge and in addition, with an autoclave function. It will be further appreciated that while six basket members 16 have been indicated for use in carrier number 12, any number of such basket members could be employed to accommodate the geometric design of the carrier. While the basket members are constructed for use with small component plastic and rubber parts, it will be appreciated that retaining features could be utilized therein to clean frangible components such as glassware.

It will thus be seen that through the present invention there is now provided a washing apparatus which is particularly suitable for cleaning and drying small component parts to be utilized in the manufacture of I.V. administration sets. The unit is especially adapted to be easily loaded and unloaded and at the same time to assure that the parts are thoroughly clean and fre of grease and particulate matter when they leave the washing apparatus. The apparatus is constructed to be highly automated, yet can be fabricated from existing component parts so that the cost thereof is not excessive.

The foregoing invention can now be practiced by those skilled in the art. Such skilled person will know that the invention is not necessarily restricted to the particular embodiments presented herein. The scope of the invention is to be defined by the terms of the following claims as given meaning by the preceding description.

We claim:

1. A washing apparatus for cleaning small component parts with a washing fluid comprising:

a carrier member;

a frame and housing member to enclose and support said carrier member in a rotatable manner on a horizontal axis;

means to rotate said carrier member;

a plurality of basket members carred by said carrier member;

said basket members defining a door member and at least one wall section formed of a material which will retain said parts therein but will allow said washing fluid to enter and exit therefrom;

nozzle means disposed inside said housing member and arranged to direct said washing fluid into said basket members at predetermined positions;

washing fluid conduit means connected to said nozzle means;

means defined by said housing member to drain said washing fluid from said housing at a position below said nozzle means;

said housing member defining an opening therein of a dimension which will permit said basket members to pass therethrough;

a closure member operatively associated with said housing to close said opening; and means operatively associated with said basket member and said carrier member which will secure said basket member in one position within the confines of said carrier member and in another position will allow said basket members to be positioned through the opening in said housing to extend to the outside of said housing;

so that said basket members can be extended from said carrier member, through said opening to be disposed outside said housing member for loading of said component parts and subsequently moved back inside said housing for engagement with said carrier member.

2. The washing apparatus as defined in claim 1 wherein said means to secure said basket members in said carrier member is defined by a locking mechanism of the slide-bar type carried by said basket members which slide bolts engage said carrier member.

3. The washing apparatus as defined in claim 2 wherein said locking mechanism further includes a key member for actuating said locking mechanism.

4. The washing apparatus as defined in claim 3 wherein said carrier member is defined by spaced radial arm members with said basket members constructed and arranged to fit within the confines of said arm members.

5. The washing apparatus as defined in claim 4 wherein said basket members are constructed with perforated sheet material side, top, bottom and front wall members.

6. The washing apparatus as defined in claim 5 wherein said means to allow said basket members to be positioned through said housing opening comprises pivotal means attaching said basket to said carrier member, said pivotal means constructed and arranged in conjunction with said carrier members, said baskets and said housing opening so that said front wall member can be pivoted below a horizontal position for ease in emptying said component parts from said baskets.

7. The washing apparatus as defined in claim 6 wherein roller means are further included and disposed adjacent said housing opening for slidable contact with a portion of said basket members.

8. The washing apparatus as defined in claim 1 wherein said nozzle means are disposed above said basket members as well as at the sides and centrally of said carrier member.

9. The washing apparatus as defined in claim 8 further including means to introduce hot air into said housing and adjacent the center of said carrier member.

10. The washing apparatus as defined in claim 1 wherein said washing fluid conduit means includes a holding tank, filter means and pump means for recycling said washing fluid to said holding tank and filter means.

11. The washing apparatus as defined in claim 10 further including a source of distilled water with said source of distilled water connected to said washing fluid conduit means.

12. The washing apparatus as defined in claim 11 further including means to introduce a detergent material into said housing member.

* * * * *